US005916867A

United States Patent [19]

Aouad et al.

[11] Patent Number: 5,916,867

[45] Date of Patent: Jun. 29, 1999

[54] PROCESS FOR PREPARING DETERGENT GRANULES

[75] Inventors: Yousef Georges Aouad, Jeddah, Suriname; Hayden Guy William Dickenson, Newcastle upon Tyne, United Kingdom

[73] Assignee: The Procter & Gamble Company, Cincinnati, Ohio

[21] Appl. No.: 08/676,207

[22] PCT Filed: Jan. 13, 1995

[86] PCT No.: PCT/US95/00568

§ 371 Date: Jul. 17, 1996

§ 102(e) Date: Jul. 17, 1996

[87] PCT Pub. No.: WO95/19421

PCT Pub. Date: Jul. 20, 1995

[30] Foreign Application Priority Data

Jan. 17, 1994 [EP] European Pat. Off. ..... 94300302

[51] Int. Cl.[6] ..... C11D 11/00

[52] U.S. Cl. ..... 510/444; 510/451; 510/495; 510/498; 510/511; 264/141

[58] Field of Search ..... 510/444, 451, 510/498, 495, 511; 264/141

[56] References Cited

U.S. PATENT DOCUMENTS

| | | | |
|---|---|---|---|
| 3,936,537 | 2/1976 | Baskerville, Jr. et al. | 427/242 |
| 4,115,308 | 9/1978 | Guerry | 252/135 |
| 4,412,934 | 11/1983 | Chung et al. | 252/186.38 |
| 4,457,854 | 7/1984 | Gangwisch et al. | 252/91 |
| 4,483,781 | 11/1984 | Hartman | 252/174.12 |
| 4,680,131 | 7/1987 | Busch et al. | 510/444 |
| 4,925,585 | 5/1990 | Strauss et al. | 252/89.1 |
| 5,178,798 | 1/1993 | Jolicoeur | 252/553 |
| 5,318,733 | 6/1994 | Carduck et al. | 264/15 |
| 5,451,354 | 9/1995 | Aouad et al. | 264/117 |
| 5,597,789 | 1/1997 | Sadlowski | 510/230 |

FOREIGN PATENT DOCUMENTS

| | | | |
|---|---|---|---|
| 438320 A2 | 7/1991 | European Pat. Off. | C11D 17/06 |
| 0508543 | 10/1992 | European Pat. Off. . | |
| 91/02047 | 2/1991 | WIPO . | |
| 9218602 | 10/1992 | WIPO . | |

*Primary Examiner*—Lorna Douyon
*Attorney, Agent, or Firm*—Jacobus C. Rasser; Kim W. Zerby; D. Mitchell Goodrich

[57] ABSTRACT

A process for making a detergent component having a bulk density of at least 650 g/l, which comprises the steps of:

(i) forming a structured paste comprising a uniform mixture of, by weight;
  (a) from 5% to 40% of water;
  (b) from 30% to 90% of an ingredient selected from the group consisting of anionic, zwitterionic, cationic, ampholytic and nonionic surfactant; water-soluble organic polymer; and mixtures thereof;
  (c) from 1% to 20% of water-soluble silicate salt;
  (d) at least 30% of linear alkyl benzene sulphonate;

in a continuous process; wherein the maximum pressure reached in step (i) is not less than 10 bar; and (ii) subsequently dispersing said structured paste with one or more builders in powder form; in a high shear mixer at a tip speed of greater than 10 meters per second; wherein the ratio of the structured paste to the builder powder is from 9:1 to 1:5.

8 Claims, No Drawings

PROCESS FOR PREPARING DETERGENT GRANULES

TECHNICAL FIELD

The present invention relates to a process for making a high bulk density detergent component by forming a structured surfactant paste, and subsequently granulating the paste to form free-flowing particles having a bulk density of at least 650 g/l.

BACKGROUND OF THE INVENTION

In recent years there has been a trend towards making granular detergents having a higher bulk density than before. Various techniques of making dense granular detergents, and of processing low density granular detergents in such a way that the bulk density is increased, have been described. One example of a suitable technique for making dense granular detergents is known as "agglomeration". This term describes any process in which small particles of the components are processed in such a way that they are built-up (or "agglomerated") to form suitable granular components.

The ideal detergent agglomerate should have a high bulk density and a high surfactant content and yet still have good solubility and dispersion properties. It should also be possible to use a manufacturing process which is both efficient and versatile.

Different approaches to these objectives have been made in the prior art.

U.S. Pat. No. 4,970,017, issued on Nov. 13, 1990, discloses a process for preparing a detergent composition containing silicate in a kneader. The resulting composition is a solid which is shaped into pellets and then passed through a grinding step to reduce the particle size to a suitable powder.

EPA402111, published on Dec. 12, 1990, describes a process for preparing a dough which comprises surfactant, followed by a granulation step. The dough may comprise a "deagglomerating" agent but the particular benefits of combining certain surfactants with silicate are not disclosed. The surfactant dough is prepared by a mixing process, but extrusion is preferably avoided. A process of this type is described in th prior art portion of claim 1.

EPA508543, published on Oct. 14, 1992, discloses a process for preparing a high active surfactant paste composition in an extruder. Although a number of possible chemical stucturants and surfactants are mentioned, there is no disclosure of the particularly efficient structuring by a combination of silicate and linear alkyl benzene sulphonate at elevated pressures.

Whilst the prior art suggests the use of silicate in various granulation processes, problems of defining a process which is economical on an industrial scale, and which provides granular detergents having high surfactant activity remain. It is an aim of the present invention to provide a process for converting a surfactant paste into a free-flowing granular detergent having high surfactant activity and good handling and performance properties. In order to achieve the particular benefits of the process of the invention a specific surfactant paste which comprises silicate and linear alkyl benzene sulphonate is provided, the paste having a particular liquid crystal structure which is highly desirable in the process of the present invention.

It has now been surprisingly found that it is advantageous to incorporate a water-soluble silicate salt into the surfactant paste which comprises linear alkyl benzene sulphonate. The combination of these two specific ingredients, under conditions of high pressure such as those which may be created behind a die plate of an extruder, results in a surprising improvement of the effectiveness of structuring of the paste. The structured paste which has been forced under pressure through the extruder die no longer has the properties of a viscous liquid, but rather has the properties of a deformable solid. This can then be finely dispersed and agglomerated with builder powders to give a free-flowing granular composition which have an activity of at least 35%, preferably at least 50%.

SUMMARY OF THE INVENTION

The present invention relates to a process for making a detergent component having a bulk density of at least 650 g/l, which comprises the steps of:

(i) forming a structured paste comprising a uniform mixture of, by weight;
  (a) from 5% to 40% of water;
  (b) from 30% to 90% of an ingredient selected from the group consisting of anionic,including at least 30% of linear alkyl benzene sulphonate, zwitterionic, cationic, ampholytic and nonionic surfactant; water-soluble organic polymer; and mixtures thereof;
  (c) from 1% to 20% of water-soluble silicate salt;

in a continuous process; wherein the maximum pressure reached in step (i) is not lees than 10 bar; and (ii) subsequently dispersing said structured paste with one or more builders in powder form; in a high shear mixer at a tip speed of greater than 10 meters per second; wherein the ratio of the structured paste to the builder powder is from 9:1 to 1:5.

Step (i) of the process may be carried out by extruding the structured paste through a die; the pressure at the upstream side of the die being from 20 to 100 bar, preferably 20 to 60 bar, and the temperature of the structured paste at the die being greater than 40° C., more preferably 60° C. to 100° C. Furthermore step (i) typically has a residence time of from 10 seconds to 300 seconds (preferably from 30 to 90 seconds) and is typically carried out under the specific mechanical energy input of from 5 to 50 Whr/kg of extrudate.

The structured paste which is formed in step (i) of the process preferably has a viscosity of at least 20 mPas when measured at 70° C. and 25 sec-1, more preferably from 30 to 100 mPas.

The structured paste preferably comprises from 40% to 85% by weight of anionic surfactant which may be a mixture of C10–18 alkyl sulphate and C10–18 linear alkyl benzene sulphonate in a ratio of from 2:1 to 1:4. More preferably the structured paste comprises at least 40% by weight of linear alkyl benzene sulphonate, the ratio of linear alkyl benzene sulphonate to water soluble silicate salt being from 100:1 to 2:1.

The water-soluble silicate salt which acts as the paste structurant is preferably sodium silicate having a ratio of $SiO_2$ to $Na_2O$ of from 0.5:1 to 3.3:1, preferably from 1.0:1 to 2.4:1.

Whilst either sodium silicate solution or powder may be used, it is preferred that it is added in the form of a powder. In particular, benefits are achieved if the sodium silicate powder is micronised, typically having a mean particle size of less than 100 micrometers.

Step (ii) of the process wherein the temperature of the mixture of the structured paste and builder powders in the high shear mixer is between 35° C. and 100° C. Suitable builder powders may be chosen from a wide range of known builders including aluminosilicate, carbonate, citrate, sulphate and mixtures thereof.

DETAILED DESCRIPTION OF THE INVENTION

According to the present invention, an essential process step is the formation of a structured paste comprising surfactants and water-soluble silicate. Suitable surfactant pastes are described in more detail below.

Surfactant Paste

One or various aqueous pastes of the salts of anionic surfactants is preferred for use in the present invention, preferably the sodium salt of the anionic surfactant. While granulation using various pure or mixed surfactants is known, for the present invention to be of practical use in industry and to result in particles of adequate physical properties to be incorporated into granular detergents, the surfactant (including linear alkyl benzene sulphonate) must be part of the paste in a concentration of from 30 to 90% by weight.

The activity of the aqueous surfactant paste premix is preferably at least 40%; preferred activities are: from 50% to 85% and, more preferred from 65 to 80%. The balance of the paste is primarily water and water-soluble silicate but can include various other detergent components, some of which are described in more detail below. Particularly suitable components of the paste also include polycarboxylates, phosphonates, succinates, brightener, dye such as those described in more detail below. The aqueous surfactant paste premix contains at least 30% of linear alkyl benzene sulphonate, and optionally organic surfactant selected from the group consisting of anionic, zwitterionic, ampholytic and cationic surfactants, and mixtures thereof. Anionic surfactants are preferred. Surfactants useful herein are listed in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. No. 4,239,659, Murphy, issued Dec. 16, 1980. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulphuric reaction products having in their molecular structure an alkyl group containing from about 10 to about 20 carbon atoms and a sulphonic acid or sulphuric acid ester group. (Included in the term "alkyl" is the alkyl portion of acyl groups.) Examples of this group of natural or synthetic surfactants are the linear or branched, primary or secondary, sodium and potassium alkyl sulphates, especially those obtained by sulphating the higher alcohols ($C_8$–$C_{18}$ carbon atoms) such as those produced by reducing the glycerides of tallow or coconut oil. Examples of the linear alkyl benzene sulphonate which are used in the present invention include the sodium and potassium alkyl benzene sulphonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulphonates in which the average number of carbon atoms in the alkyl group is from about 11 to 13, abbreviated as $C_{11}$–$C_{13}$ LAS.

Other anionic surfactants herein are the sodium alkyl glyceryl ether sulphonates, especially those ethers of higher alcohols derived from tallow and coconut oil; sodium coconut oil fatty acid monoglyceride sulphonates and sulphates; sodium or potassium salts of alkyl phenol ethylene oxide ether sulphates containing from about 1 to about 10 units of ethylene oxide per molecule and wherein the alkyl groups contain from about 8 to about 12 carbon atoms; and sodium or potassium salts of alkyl ethylene oxide ether sulphates containing from about 1 to about 10 units of ethylene oxide per molecule and wherein the alkyl group contains from about 10 to about 20 carbon atoms.

Other useful anionic surfactants herein include the water-soluble salts of esters of alpha-sulphonated fatty acids containing from about 6 to 20 carbon atoms in the fatty acid group and from about 1 to 10 carbon atoms in the ester group, including methyl ester sulphonate; water-soluble salts of 2-acyloxy-alkane-1-sulphonic acids containing from about 2 to 9 carbon atoms in the acyl group and from about 9 to about 23 carbon atoms in the alkane moiety; water-soluble salts of olefin sulphonates containing from about 12 to 24 carbon atoms; and beta-alkyloxy alkane sulphonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

The preferred anionic surfactant pastes comprise mixtures of linear or branched alkylbenzene sulphonates having an alkyl of 10–18 carbon atoms and alkyl sulphates having an alkyl of 10–18 carbon atoms. Most preferably the ratio of alkyl benzene sulphonate to alkyl sulphate is from 4:1 to 1:4. These pastes are usually produced by reacting a liquid organic material with sulphur trioxide to produce a sulphonic or sulphuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used.

Water-soluble nonionic surfactants are also useful as surfactants in the compositions of the invention. A suitable paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the conden sat ion of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Included are the water-soluble condensation products of aliphatic alcohols containing from 8 to 22 carbon atoms, in either straight chain or branched configuration, with from 4 to 25 moles of ethylene oxide per more of alcohol and, in particularly, the condensation products of alcohols having an alkyl group containing from about 9 to 15 carbon atoms with from about 4 to 11 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms ; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulphoxides containing one alkyl moiety of from about 10 to 18 carbon atoms and a moiety selected from the group consisting of alkyl and hydroxyalkyl moieties of from about 1 to 3 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocoalkyl trimethyl ammonium methosulphate.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulphonium compounds in which one of the aliphatic substituents contains from about 8 to 18 carbon atoms.

The surfactant paste is structured by intimate mixing with a water-soluble silicate. Particularly suitable water-soluble silicates are defined in more detail below.

The term structuring is used herein to mean modification of the phase chemistry (liquid crystal structures) of the surfactant paste to achieve a phase in which the viscosity of the surfactant paste is increased. Various ways of characterising the phase chemistry of a paste are known including Differential Scanning Calorimetry and X-ray Diffraction.

Important parameters of the surfactant pastes which can affect the effectiveness of the structuring are the paste temperature and pressure.

The effectiveness of the structuring of the paste determines its viscosity which in turn influences the mixing and granulation step. Viscosity is a function, among others, of concentration and temperature, with a range in this application from 10 mPas to 10,000 mPas. Preferably, the viscosity of the structured paste is from 20 to 200 mPas and more preferably from 50 to 150 mPas. The viscosity of the paste of this invention is measured at a temperature of 70° C. when measured at $25s^{-1}$. For the present purposes a Physica Viscotherm VT100 was used for measuring viscosity.

Water-soluble silicates which are suitable for use in the present invention may be amorphous or layered.

Such silicates may be characterised by the ratio of $SiO_2$ to $Na_2O$ in their structure. In the present invention, this ratio may typically be less than 3.3:1, preferably less than 2.8:1, more preferably less than 2.4:1, most preferably about 2.0:1.

In terms of the present invention, amorphous silicates are preferred to crystalline silicates. However, crystalline silicates may be included in the paste compositions of the invention.

Crystalline layered sodium silicates have the general formula $$NaMSi_xO_{2x+1}.\ yH_2O$$

wherein m is sodium or hydrogen, x is a number from 1.9 to 4 and y is a number from 0 to 20. Crystalline layered sodium silicates of this type are disclosed in EP-A 164 514 and methods for their preparation are disclosed in DE-A 34 17 649 and DE-A 37 42 043. For the purpose of the present invention, x in the general formula above has a value of 2, 3 or 4 and is preferably 2. More preferably M is sodium and y is ) and preferred examples of this formula comprise the α- , β- , γ- , δ- forms of $Na_2Si_2O_5$. These materials are available from Hoechst AG, Germany, as, respectively, NaSKS-5, NaSKS-7, NaSKS-11 and NaSKS-6. The most preferred material is δ- $Na_2Si_2O_5$, NaSKS-6.

The structured surfactant pastes of the present invention preferably comprise amorphous silicate or crystalline layered silicate at a level of from 1% to 20% by weight, preferably from 3% to 8%.

It has now been found that the particle size of the silicate particles of the present invention can contribute to the effectiveness of structuring the paste. It is preferable that fine silicate particles are used. Preferably the mean particle size of the silicate is less than 100 micrometers, more preferably less than 50 micrometers.

The uniform mixture of the surfactant paste and the silicate structurant required in step(i) of the present invention may be carried out using any suitable mixing equipment. One particularly suitable piece of equipment is a twin screw extruder.

Twin Screw Extruder

The extruder fulfills the functions of pumping and mixing the viscous surfactant paste and the silicate structurant on a continuous basis. A basic extruder consists of a barrel with a smooth inner cylindrical surface. Mounted within this barrel is the extruder screw. There is an inlet port for the high active paste which, when the screw is rotated, causes the paste to be moved along the length of the barrel.

The detailed design of the extruder allows various functions to be carried out. Firstly additional ports in the barrel may allow other ingredients, including the silicate structurant to be added directly into the barrel. Secondly a vacuum pump and a seal around the shaft of the screw allows a vacuum to be drawn which enables the moisture level to be reduced. Thirdly means for heating or cooling may be installed in the wall of the barrel for temperature control. Fourthly, careful design of the extruder screw promotes mixing of the paste both with itself and with the structurant and other additives. For example kneading sections may be included in the screw design.

A preferred extruder is the twin screw extruder. This type of extruder has two screws mounted in parallel within the same barrel, which are made to rotate either in the same direction (co-rotation) or in opposite directions (counter-rotation). The co-rotating twin screw extruder is the most preferred piece of equipment for use in this invention.

Suitable twin screw extruders for use in the present invention include those supplied by: APV Baker, (CP series); Werner and Pfleiderer, (Continua Series); Wenger, (TF Series); Leistritz, (ZSE Series); and Buss, (LR Series).

The residence time of the surfactant paste in the twin screw extruder is typically from 10 seconds to 300 seconds, preferably from 30 to 90 seconds.

It is most preferred that the die plate of the extruder has between 1 and 10 extrusion holes, the exact number depending on the throughput rate of extrudate required. Furthermore extrusion holes which are rectangular in cross-section are preferred over other shapes such as circular cross-section holes. A typical preferred hole shape is about 25 mm long, and from 1.5 to 2.5 mm wide.

In the second step of the process of the present invention, the structured paste is granulated in the presence of builder powders. Typically the granulation step involves making a fine dispersion of the structured paste with the builder powders in conditions which cause the dispersed paste and builders to agglomerate together forming granules. This process step is referred to herein as "fine dispersion mixing and granulation".

For the purposes of the present invention it is important to distinguish the differences between a grinding process, and a fine dispersion mixing and granulation process. A grinding process of the type described in the prior art is a process of size reduction in which a solid pellet is disintegrated to form a powder. A suitable piece of equipment for a grinding process is a speed mill. A fine dispersion mixing and granulation process, however, is a process in which finely divided powders and finely dispersed liquids or pastes are mixed, usually under high shear conditions, causing them to agglomerate which is a process of size enlargement. Suitable pieces of equipment for carrying out fine dispersion mixing and granulation are described below.

Fine Dispersion Mixing and Granulation

Any apparatus, plants or units suitable for the processing of surfactants can be used for carrying out the process according to the invention. For fine dispersion mixing and granulation any of a number of mixers/agglomerators can be used. In one preferred embodiment, the process of the invention is continuously carried out. Especially preferred are mixers of the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna® V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series FM for batch mixing, series CB and KM for continuous mixing/agglomeration, manufactured by Lodige Machinenbau GmbH, Paderborn Germany; Drais® T160 series, manufactured by Drais Werke GmbH, Mannheim Germany; and Winkworth® RT 25 series, manufactured by Winkworth Machinery Ltd., Berkshire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

The paste can be introduced into the mixer at an initial temperature between its softening point (generally in the range of 40–60° C.) and its degradation point (depending on the chemical nature of the paste, e.g. alkyl sulphate pastes tend to degrade above 75–85° C.). High temperatures reduce viscosity simplifying the pumping of the paste but result in lower active granules. For these reasons it is preferred that the temperature during the fine dispersion mixing and granulation step is between 35° C. and 100° C., preferably between 40° C. and 80° C., and more preferably between 50° C. and 70° C.

Other components

Builder powders suitable for use in the fine dispersion mixing and granulation step may be chosen from a wide range of suitable powders. Preferred are aluminosilicate, carbonate, citrate, sulphate and mixtures thereof.

Suitable crystalline aluminosilicate ion exchange material have the formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq.

$CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, Zeolite P, and Zeolite X. In an especially preferred embodiment, the crystalline aluminosilicate ion exchange material has the formula $$Na_{12}[(AlO_2)_{12}(SiO2)_{12}].xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density to the detergent granules herein. While some of the salts are inert, many of them also function as detergency builder materials in the laundering solution.

Citric acid and, in general, any other organic or inorganic acid may be incorporated into the granular detergents of the present invention as long as it is chemically compatible with the rest of the granule composition.

Other useful water-soluble builder salts include the compounds various water-soluble, alkali metal, ammonium or substituted ammonium phosphates, polyphosphates, phosphonates, polyphosphonates, carbonates, silicates, borates, and polyhyroxysulphonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

Examples of other neutral water-soluble salts include the alkali metal, ammonium or substituted ammonium chlorides, fluorides and sulphates. The alkali metal, and especially sodium, salts of the above are preferred. Sodium sulphate is typically used in detergent granules and is a particularly preferred salt.

Detergent compositions of the present invention may, optionally, include anti-redeposition and soil suspension agents, bleach activators, optical brighteners, soil release agents, suds suppressors, enzymes, fabric softening agents, perfumes and colours, as well as other ingredients known to be useful in laundry detergents.

Anti-redeposition and soil-suspension agents suitable herein include cellulose derivatives such as methylcellulose, carboxymethylcellulose and hydroxyethycellulose, and homo-or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

In a preferred embodiment of the present invention, the composition comprises peroxyacid bleach precursor. The solid peroxyacid bleach precursors of the present invention comprise precursors containing one or more N— or O— acyl groups, which precursors can be selected from a wide range of classes.

Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864,798, 1147871 and 2143231 and imides such as are disclosed in GB-A-855735 & 1246338.

Particularly preferred precursor compounds are the N-,N, $N^1N^1$ tetra acetylated compounds of formula

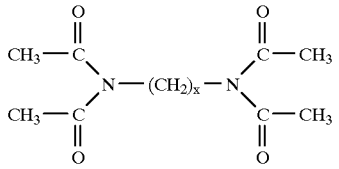

wherein x can be 0 or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Other activators are perbenzoic acid precursors such as benzoyloxybenzene sulphonate (BOBS) and benzoyl caprolactam.

It is most preferred that a peroxyacid bleach precursor is present at a level of at least 0.5% by weight of the composition. The particles of peroxyacid bleach precursor preferably have a particle size of from 100 micrometers to 1500 micrometers.

These peroxyacid bleach precursors can be partially replaced by preformed peracids such as N,N phthaloylaminoperoxy acid (PAP), nonyl amide of peroxyadipic acid (NAPAA), 1,2 diperoxydodecanedioic acid (DPDA) and trimethyl ammonium propenyl imidoperoxy mellitic acid (TAPIMA). Other bleach precursors include glycolate esters (described in EP 507475); 4h-3,1-benzoxazin-4 ones; cationic precursors (described in EP 458396 and EP 464880); ester carbonate activators (described in EP 475511), NOBS, iso-NOBS.

Preferred optical brighteners are anionic in character, examples of which are disodium 4,4$^1$-bis-(2-diethanolamino-4-anilino-s-triazin-6-ylamino)stilbene-2:2$^1$ disulphonate, disodium 4,4$^1$-bis-(2-morpholino -4-anilino-2-triazin-6-ylaminostilbene-2:2$^1$-disulphonate,disodium 4,4$^1$-bis-(2,4-dianilino-s-triazin-6-ylamino)stilbene-2:2$^1$-disulphonate, monosodium 4$^1$,4$^{11}$-bis-(2,4-dianilino-s-triazin- 6 ylamino)stilbene-2-sulphonate, disodium 4,4$^1$-bis-(2-anilino-4-(N-methyl-N-2-hydroxyethylamino)-2-triazin-6-ylamino)stilbene-2,2$^1$- disulphonate, disodium 4,4$^1$-bis-(4-phenyl-2,1,3-triazol-2-yl)stilbene-2,2$^1$ disulphonate, disodium 4,4$^1$bis(2-anilino-4-(1-methyl-2-hydroxyethylamino)-s-triazin-6-ylamino)stilbene-2,2$^1$disulphonate and sodium 2(stilbyl-4$^{11}$-(naphtho-1$^1$,2$^1$:4,5)-1,2,3-triazole-2$^{11}$-sulphonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0272033. A particular preferred polymer in accordance with EP-A-0272033 has the formula $$(CH_3(PEG)_{43})_{0.75}\ (POH)_{0.25}(T—PO)_{2.8}(T\text{-}PEG)_{0.4}]T(PO—H)_{0.25}((PEG)_{43}CH_3)_{0.75}$$

where PEG is —$(OC_2H_4)O$—, PO is $(OC_3H_6O)$ and T is $(pCOC_6H_4CO)$ .

Certain polymeric materials such as polyvinyl pyrrolidones typically of MWt 5000–20000, preferably 10000–15000, also form useful agents in preventing the transfer of labile dyestuffs between fabrics during the washing process.

Another optional detergent composition ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

The suds suppressors described above are normally employed at levels of from 0.001% to 0.5% by weight of the composition, preferably from 0.01% to 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix.

Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are examplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0026527 & 528. Other useful organic fabric softening agents are the dilong chain amides as disclosed in EP-B-0242919. Additional organic ingredients of fabric softening systems include high molecular weight polyethylene oxide materials as disclosed in EP-A-0299575 and 0313146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

It is also within the scope of the present invention that the resulting detergent granules may be dried, cooled and/or dusted with a suitable surface coating agent.

EXAMPLES

An aqueous surfactant paste containing the sodium salts of the anionic surfactants linear alkyl benzene sulphonate (LAS), tallow alkyl sulphate (TAS) and alkyl ether sulphate with an average of 3 ethoxy groups per molecule (AE3S) was prepared at a ratio of 74:24:2. The paste had a total surfactant activity of 77%, a water content of 18% and a viscosity of 28,000 mPa.s when measured at a shear rate of 25 $sec^{-1}$ and a temperature of 70° C.

A powder stream containing a mixture of zeolite A, sodium carbonate, and carboxymethylcellulose (CMC) at a ratio of 60:36:4 was continuously mixed.

The paste was pumped at 65° C. by a positive displacement pump into the first barrel of a 5 barrel-long Werner &

Pfleiderer® C170 Twin Screw Extruder (TSE) which feeds directly into a Loedige® CB55 high shear mixer and, simultaneously, the powder stream was fed into the mixer.

Also flowing into the mixer were two streams containing the recycle of the classification of the agglomerates, one containing wet, coarse products and the other one dry, fine particles. A third stream containing the dust collected from the fluid bed dryer was also fed into the mixer at a very low rate (<100 kg/hour).

The Loedige® CB 55 mixer was operated at 1460 rpm and an average residence time of 10–15 seconds. The product leaving the high speed mixer consists of a dispersion of anionic surfactant paste and powders, substantially in the form of a fine dust.

This product was then transferred by bucket elevator into a Loedige® KM 3000 moderate speed mixer. The shaft carrying the ploughshares of the moderate speed mixer was operated at 110 rpm. Additionally, four high speed choppers were installed on shafts radially mounted in the side wall of the mixer and operated at 3000 rpm. After about ¾ of the horizontal length of the mixer, a stream of zeolite A was added at a rate of 0.55 tonnes/hour.

The residence time in the moderate speed mixer may be controlled by means of an outlet gate. Closing this gate causes the weight of product which is held within the mixer to increase, which in turn increases the residence time. In these examples, the outlet gate was fully open and giving a residence time of below 1 minute.

The product leaving the Loedige® KM 3000 moderate speed mixer consisted of well defined agglomerated granules. These wet agglomerates were classified in a vibrating sieve to separate the coarse fraction and return it to the high shear mixer by means of a vibrating chute. The remaining agglomerates were dried and cooled in a fluid bed drier followed by a fluid bed cooler. The product leaving the cooler was sieved to remove the fines which were then also recycled back to the high shear mixer. The residence time in the fluid beds was about 15–30 minutes in total and the equilibrium relative humidity of the product at the outlet when measured at room temperature was between 5 and 15%.

The final agglomerated granules made in this example had a mean particle size around 540 micrometers, the fraction not passing through a Tyler sieve mesh 14 (coarser than 1180 microns) was below 10%, and the fraction passing through a Tyler sieve mesh 60 (finer than 250 microns) was below 7%.

These agglomerates were then used as components of a finished detergent composition by dry mixing with a blown powder containing polymer, zeolite and minors (and optionally TAS), and further mixing with granular silicate, granular carbonate, granular perborate or granular percarbonate, and agglomerates comprising bleach activator. The final compositions are given herein below.

Into the TSE, both the surfactant paste and a powdered structuring agent were fed into barrel 1. The structuring agent was fed just upstream of the paste and both were mixed, kneaded, conveyed and extruded through a die. The screw configuration used in this example consisted of a conveying section followed by six right-handed (30° angle) kneading blocks in groups of two and alternated with conveying sections, a left-handed kneading block (30° angle) and a final conveying section before the die plate.

Two die designs were employed in this example,

| | | Slit dimensions (mm) | | |
|---|---|---|---|---|
| Die No | No slits | Width | Height | Depth |
| 1 | 1 | 37 | 3.5 | 38 |
| 2 | 2 | 23 | 1.5 | 38 |

The structuring agent used in these experiments fed into the TSE along with the paste was powder grade sodium silicate ($SiO_2/Na_2O$ 2:1) with an average particle size of 150 microns. The powder was at room temperature.

The following experimental runs were performed with the equipment and the raw materials described above achieving the corresponding agglomerate activities indicated in the table below:

| Die No | Paste Rate (Ton/hr) | Silicate Rate (Kg/hr) | RPM | Torque (%) | Specific Mech. Energy (Whr/kg) | Pressure at die (bar) | Temp. Outlet (° C.) | Activity Aggl. (%) |
|---|---|---|---|---|---|---|---|---|
| None | 1.5–2.5 | — | 0–200 | <10 | <20 | <10 | 60–80 | 31–35 |
| 1 | 1.5 | 30 | 160 | 14 | 18 | 14 | 73 | 36 |
| 1 | 1.5 | 30 | 200 | 14 | 20 | 18 | 75 | 35 |
| 1 | 2.5 | 50 | 200 | 14 | 12 | 17 | 73 | 37 |
| 1 | 2.5 | 70 | 200 | 14 | 12 | 17 | 72 | 37 |
| 2 | 2.5 | 70 | 120 | 26 | 13 | 36 | 87 | 43 |
| 2 | 2.5 | 70 | 150 | 24 | 15 | 34 | 84 | 42 |
| 2 | 2.5 | 70 | 170 | 22 | 16 | 32 | 90 | 41 |
| 1 | 1.5 | 50 | 150 | 12 | 13 | 14 | 67 | 38 |
| 1 | 1.5 | 40 | 170 | 14 | 17 | 18 | 73 | 37 |
| 1 | 1.5 | 30 | 180 | 14 | 18 | 18 | 75 | 37 |
| 1 | 1.5 | 30 | 200 | 13 | 19 | 18 | 79 | 36 |
| 2 | 2.5 | 70 | 170 | 22 | 16 | 32 | 84 | 40 |
| 2 | 2.5 | 70 | 150 | 24 | 15 | 35 | 91 | 42 |
| 2 | 2.5 | 70 | 120 | 26 | 13 | 36 | 88 | 43 |
| 2 | 2.5 | 50 | 150 | 28 | 18 | 42 | 85 | 44 |
| 2 | 2.5 | 50 | 140 | 28 | 17 | 43 | 86 | 46 |
| 2 | 2.5 | 50 | 120 | 28 | 14 | 43 | 65 | 46 |
| 2 | 2.5 | 150 | 135 | 20 | 11 | 20 | 81 | 39 |
| 2 | 2.5 | 150 | 135 | 30 | 17 | 42 | 76 | 44* |

*Cooling was applied in the barrels and the screw shafts of the TSE with refrigerant at −20° C.

Example 2

Two aqueous surfactant pastes with the following compositions

| | | | | | |
|---|---|---|---|---|---|
| Paste 1: | LAS | 77 | Paste 2: | LAS | 37 |
| | Water | 19 | | TAS | 37 |
| | Miscellaneous | 4 | | AE3S | 3 |
| | | 100 | | Water | 19 |
| | | | | Miscellaneous | 4 |
| | | | | | 100 |

are mixed at a ratio of paste 1/paste 2 of 53/47. They are then fed simultaneously into the same TSE described in example 1.

Paste 1 had a viscosity of 20,000 mPa.s when measured a shear rate of 25 $sec^{-1}$ and a temperature of 70° C., and paste 2 had a viscosity of 26,000 mPa.s under the same test conditions. Paste 1 is stored at 79° C. and paste 2 at 67° C.

A powder stream of powder grade sodium silicate 2.0 R ($SiO_2/Na_2O$ 2:1) silicate also enters the TSE. The average particle size of the powder is 150 microns. Both paste and powder streams were fed into the TSE into barrel 1 as described in example 1. The screw configuration used in this example consisted of screw elements followed by a combination of elements with 3 right-handed kneading blocks.

One die design was used in this example, this die consisted of 2 rectangular slits, each having the same dimensions of width: 23 mm, height: 1.5 mm and depth: 38 mm.

The outlet of the TSE is connected directly into a Loedige® CB55 high shear mixer. Also entering the high shear mixer is a well mixed powder stream containing a mixture of zeolite A, sodium carbonate, and carboxymethylcellulose (CMC) at a ratio of 49:46:5.

The paste and powder streams are granulated in a similar granulation process as that described in example 1. In this example, though, additional zeolite A was added to the process at 3 points, at a total rate of 900 kg/hr. These addition points were about ⅔ and ¾ along the horizontal length of the moderate speed mixer, and at the exit of the product cooler. The split of zeolite to these points is in the ratio of 8:1:1. (It is possible also to add zeolite to the finished product stream). The rest of the process and material conditions are the same as for example 1, except that the mixing tools in the Loedige® KM 3000 moderate speed mixer are a combination of ploughshares and flat Becker® blades. The residence time with this combination of mixer tools was less than 45 seconds.

The following experimental runs were performed with the equipment and raw materials described above achieving the corresponding agglomerate activities indicated in the table below:

| Paste Rate (Ton/hr) | Silicate Paste (Kg/hr) | RPM | Torque (%) | SME (Whr/Kg) | Pressure at die (bar) | Temp. Outlet (° C.) | Aggl. Activity (%) |
|---|---|---|---|---|---|---|---|
| 2.5 | — | 80 | 40 | 19 | No die | 55 | 33 |
| 2.5 | 140 | 150 | 22 | 14 | 30 | 90 | 39 |
| 2.5 | 140 | 150 | 26 | 16 | 35 | 88* | 40 |
| 2.5 | 140 | 150 | 30 | 19 | 40 | 80* | 42 |

*Cooling was applied in the barrels and the screw shafts of the TSE with refrigerant at −20° C.

The particles made by this process exhibit excellent handling and dissolution

Example 3

In this example, an eight-barrel W&P® C37 TSE was used in continuous mode to structure the same paste described in example 1. The agglomeration experiments under different operating conditions on the paste exiting the TSE were performed in a lab-scale high shear mixer (Braun®) with a mixture of Zeolite A/light sodium carbonate in a weight ratio 1:1. In these tests, 200 grammes of the powder mixture were initially placed in the mixer and the surfactant/silicate mixture exiting the TSE is continuously fed into the mixer (while it is being operated) at a rate of about 500 g/min. The mixer was operated until agglomerates with a mean particle size between about 400 to 600 microns were produced. These agglomerates were then dried in a fluidised bed and were analyzed for anionic surfactant content (activity of the agglomerate).

As structuring agents for these examples, four types of sodium silicates were used:

1) A powder grade (mean particle size around 150 microns) with $SiO_2/Na_2O$) 2:1 ratio,
2) A very fine powder grade (mean particle size around 30 microns) with $SiO_2/Na_2O$ 2:1 ratio,
3) An anhydrous powder grade (mean particle size around 150 microns) with $SiO_2/Na_2O$ 1:1 ratio, and
4) A crystalline (pentahydrate) powder grade (mean particle size around 150 microns) with $SiO_2/Na_2O$ 1:1 ratio.

The screw configuration in the TSE consists of an initial feeding section with long pitch conveying elements followed by eight right-handed (30° angle) kneading blocks in groups of 2 with medium pitch conveying elements in between the groups, a left-handed kneading block (30° angle) and a final section with short pitch conveying elements before the die plate.

The inlet paste temperature was 60° C. in all experiments while the sodium silicates used to structure the paste were kept at room temperature. The die used consisted of one rectangular slit with 8 mm width, 0.76 mm height and 20 mm depth.

The following experimental runs were performed with the equipment and the raw materials described above, achieving the agglomerate activities indicated in the table:

| Silicate Type | Paste Rate (Kg/hr) | Powder Rate (Kg/hr) | RPM | Torque (%) | SME (Whr/kg) | Pressure at die (bar) | Temp. Outlet (° C.) | Activity Aggl. (%) |
|---|---|---|---|---|---|---|---|---|
| None | 40–70 | — | 100–400 | <10 | <20 | <10 | 40–60 | 40–45 |
| 1 | 65 | 3.4 | 300 | 22 | 18 | 36 | 54 | 48.5 |
| 1 | 64 | 3.4 | 250 | 25 | 18 | 39 | 52 | 50 |
| 1 | 67 | 3.4 | 200 | 27 | 15 | 37 | 51 | 49.5 |
| 1 | 61 | 3.4 | 150 | 33 | 15 | 40 | 52 | 52 |
| 1 | 49 | 3.4 | 125 | 32 | 15 | 41 | 52 | 55 |
| 1 | 41 | 3.4 | 100 | 35 | 15 | 47 | 50 | 56 |
| 2 | 62 | 3.4 | 400 | 32 | 37 | 53 | 55 | 57 |
| 2 | 63 | 3.4 | 350 | 33 | 33 | 53 | 55 | 57 |
| 2 | 59 | 3.4 | 300 | 25 | 23 | 54 | 52 | 55.5 |
| 2 | 60 | 3.4 | 250 | 31 | 23 | 55 | 54 | 57 |
| 2 | 62 | 3.4 | 200 | 35 | 20 | 54 | 53 | 58 |
| 2 | 60 | 3.4 | 150 | 30 | 13 | 36 | 51 | 54 |
| 2 | 40 | 3.4 | 100 | 26 | 11 | 30 | 47 | 52 |
| 3 | 61 | 3.4 | 350 | 23 | 24 | 33 | 52 | 47.5 |
| 3 | 64 | 3.4 | 300 | 24 | 20 | 36 | 52 | 48.5 |
| 3 | 63 | 3.4 | 250 | 24 | 17 | 34 | 52 | 53 |
| 3 | 64 | 3.4 | 150 | 33 | 14 | 37 | 52 | 53 |
| 4 | 63 | 3.4 | 350 | 26 | 26 | 40 | 53 | 52 |
| 4 | 62 | 3.4 | 250 | 31 | 23 | 48 | 50 | 52 |
| 4 | 62 | 3.4 | 150 | 44 | 19 | 50 | 50 | 53 |

Example 4

In this example, a 5 barrel W&P® C37 TSE was used in continuous mode to structure the same paste described in example 1. The agglomeration experiments were carried out in the way described in example 3.

The structuring agents used were the sodium silicate $SiO_2/Na_2O$ 2:1 in the form of:

1) A fine powder (average particle size around 150 microns) and
2) A very fine powder (average particle size around 30 microns).

The paste temperature at the inlet of the TSE was kept at 60° C. while all the powders used in the experiments were kept at room temperature.

The screw configuration in the TSE consists of an initial feeding section with long pitch conveying elements followed by six right-handed (30° angle) kneading blocks in groups of two with medium pitch conveying elements in between the groups, a left-handed kneading block (30° angle) and a final section with short pitch conveying elements before the die plate.

Three different die plates were used in these experiments with the following dimensions:

| | | Slit dimensions (mm) | | |
|---|---|---|---|---|
| Die No | No slits | Width | Height | Depth |
| 3 | 2 | 8 | 0.76 | 20 |
| 4 | 1 | 8 | 0.76 | 20 |
| 5 | 2 | 4 | 0.508 | 20 |

The following experimental runs were performed with the equipment and the raw materials described above, achieving the agglomerate activities indicated in the table below:

| Silicate Type | Die No | Paste Rate (Kg/hr) | Powder Rate (Kg/hr) | RPM | Torque (%) | SME (Whr/Kg) | Pressure at die (bar) | Temp. Outlet (° C.) | Aggl. Activity (%) |
|---|---|---|---|---|---|---|---|---|---|
| None | 3, 4, 5 | 40–70 | — | 100–400 | <10 | <20 | <10 | 40–70 | 40–45 |
| 1 | 3 | 40 | 2 | 100 | 16 | 7 | 15 | 56 | 49.5 |
| 1 | 3 | 40 | 2 | 150 | 14 | 10 | 15 | 55 | 49.5 |
| 1 | 3 | 40 | 2 | 200 | 12 | 11 | 13 | 60 | 48 |
| 1 | 3 | 40 | 2 | 100 | 18 | 8 | 17 | 51 | 50.5 |
| 1 | 3 | 40 | 2 | 100 | 29 | 13 | 32 | 36 | 55 |
| 1 | 3 | 55 | 2.8 | 150 | 19 | 9 | 16 | 57 | 50.5 |
| 1 | 4 | 40 | 2 | 150 | 24 | 16 | 31 | 51 | 52 |
| 1 | 4 | 40 | 2 | 150 | 24 | 16 | 32 | 56 | 50.5 |
| 1 | 5 | 40 | 2 | 150 | 30 | 20 | 44 | 60 | 51 |
| 2 | 5 | 70 | 3.5 | 300 | 44 | 34 | 75 | 62 | 57 |
| 2 | 5 | 70 | 3.5 | 300 | 31 | 24 | 50 | 71 | 47 |
| 2 | 5 | 70 | 3.5 | 300 | 41 | 32 | 78 | 60 | 58 |

We claim:

1. A process for making a detergent component having a bulk density of at least 650 g/l consisting essentially of:

(i) forming a structured paste comprising a mixture of, by weight:

(a) from 5% to 40% of water;

(b) from 30% to 90% of an ingredient selected from the group consisting of anionic, zwitterionic, cationic, ampholytic and nonionic surfactants; water-soluble organic polymers; and mixtures thereof;

(c) from 1% to 20% of water-soluble silicate salt having a particle size of less than 50 $\mu$m and having a ratio of $SiO_2$ to $Na_2O$ of from about 1:1 to about 2.4:1;

wherein the structured paste is formed by extruding the mixture through a die plate comprising a rectangular slit; the slit is from about 8 mm to about 37 mm wide and from about 0.508 mm to about 3.5 mm high; and (ii) subsequently dispersing said structured paste with one or more builders in powder form in a high shear mixer at a tip speed of greater than 10 meters per second; wherein the ratio of the structured paste to the builder powder is from 9:1 to 1:5;

wherein the structured paste comprises at least 30%, by weight, of a linear alkyl benzene sulphonate; and the ratio of linear alkyl benzene sulphonate to water-soluble silicate salt is from 100:1 to 2:1, and wherein the pressure in step (i) is from about 20 to about 100 bar.

2. A process according to claim 1 wherein the temperature of the structured paste at the die is greater than 40° C.

3. A process according to claim 2 wherein the temperature is from 60° C. to 100° C.

4. A process according to claim 1 wherein step (i) is carried out under a specific mechanical energy input of from 5 to 50 Whr/kg of extrudate.

5. A process according to claim 1 wherein said structured paste comprises from 40% to 85% by weight of anionic surfactant.

6. A process according to claim 5 wherein said structured paste comprises a mixture of $C_{10-18}$ alkyl sulphate and $C_{10-18}$ linear alkyl benzene sulphonate in a ratio of from 2:1 to 1:4.

7. A process according to claim 1 wherein the temperature of the mixture of the structured paste and builder powders in the high shear mixer is maintained between 35° C. and 100° C.

8. A process according to claim 7 wherein the builder powder is selected from the group consisting of aluminosilicate, carbonate, citrate, sulphate and mixtures thereof.

* * * * *